United States Patent [19]

Takahashi et al.

[11] 4,155,481

[45] May 22, 1979

[54] CONTAINER COVER MEMBER HAVING SYNTHETIC RESIN OPENABLE PORTION AND METHOD FOR MAKING THE SAME

[75] Inventors: Keiichi Takahashi, Ichikawa; Kikuya Hirakawa, Ebina; Yukio Sarusawa, Zama, all of Japan

[73] Assignee: Tokan Kogyo Co., Ltd., Tokyo, Japan

[21] Appl. No.: 928,304

[22] Filed: Jul. 26, 1978

[51] Int. Cl.[2] ..... B65D 41/32

[52] U.S. Cl. ..... 220/270; 220/359; 222/541; 222/485

[58] Field of Search ..... 220/260, 265, 270, 359; 229/43, 7 R; 222/541, 485

[56] References Cited

U.S. PATENT DOCUMENTS

| | | | |
|---|---|---|---|
| 3,628,688 | 12/1971 | Haggard | 220/270 |
| 3,701,453 | 10/1972 | Platt et al. | 220/270 |
| 3,967,749 | 7/1976 | Walter | 220/265 |
| 4,029,033 | 6/1977 | Kerwin et al. | 220/359 |

*Primary Examiner*—George T. Hall

[57] ABSTRACT

A container formed of paper or thermoplastic synthetic resin and having a cover member which comprises a cover sheet having an openable portion defined by weakened means such as a series of slots, slits or perforations, said slots, slits or perforations being covered by a continuous portion on at least one side of the cover member to define a continuous thermoplastic synthetic resin belt zone, said belt zone being attached to said slots slits or perforations by rivet heads for sealing the slots, slits or perforations and also having a pull tab formed at one end thereof, whereby an opening is made in the cover of said container by merely pulling said pull tab.

8 Claims, 18 Drawing Figures

CONTAINER COVER MEMBER HAVING SYNTHETIC RESIN OPENABLE PORTION AND METHOD FOR MAKING THE SAME

This invention relates to a container cover member and more particularly, to a container cover member in which an opening can be easily made by merely pulling the pull tab with fingers and if desired, the openable portion may be retained on the other part of the cover member, and a method for manufacturing the cover member.

DESCRIPTION OF PRIOR ARTS

A variety of covers for sealing containers which can be easily opened without the use of any separate opening means have been proposed.

For example, the cover of a metal can may be provided with series of identations or slits defining the configuration of the portion of the cover to be opened and a handle is connected to the portion defined by the identations or slits whereby when the handle is pulled upwardly, the cover is severed along the line of identations or slits to thereby open the container. However, the prior art container cover has a rather large number of parts and requires a rather great number of processing steps resulting in high production cost. And in such a prior art container cover, since the series of indentations or slit is not provided with any reinforcing means, said weakened portions are not so strong as the rest of the cover. Thus, the cover has the disadvantage that when the covered can containing a product therein drops or falls down, the cover breaks or gets damaged along the weakened line.

A variety of covers having easily openable portions have been employed, but in these, the part that is pulled up to define the opening is separated from the cover member when the can is opened. Then the part removed is in many cases discarded thereby polluting the environment.

SUMMARY OF THE INVENTION

Therefore, one object of the present invention is to provide a container cover member which can be opened without the use of any separate opening means and which can be easily produced at low cost.

Another object of the present invention is to provide a cover member which can be produced by injecting thermoplastic synthetic resin into weakened portion such as a through hole, through holes, slots or slits provided in a preformed cover blank with a pull tab so as to form an opening whereby the cover member can be easily opened.

Another object of the present invention is to provide a container cover member which has a pull tab acting as an opening and closing plug which is retained the cover member even after the container has been opened.

A further object of the present invention is to provide a method for producing a container cover member at low cost, which can be easily opened without the use of any separate opening means.

The above and other objects and advantages of the present invention will be more readily apparent to those skilled in the art from a reading of the following detailed description in conjunction with the accompanying drawings which show preferred embodiments of the invention for illustration purpose only, but not for limiting the scope of the same in any way.

PREFERRED EMBODIMENTS OF THE INVENTION

The present invention will be now described referring to the accompanying drawings and more particularly, to FIGS. 1 through 8 thereof in which embodiments of No. 1 type container cover member according to the present invention are shown.

Figure 1:
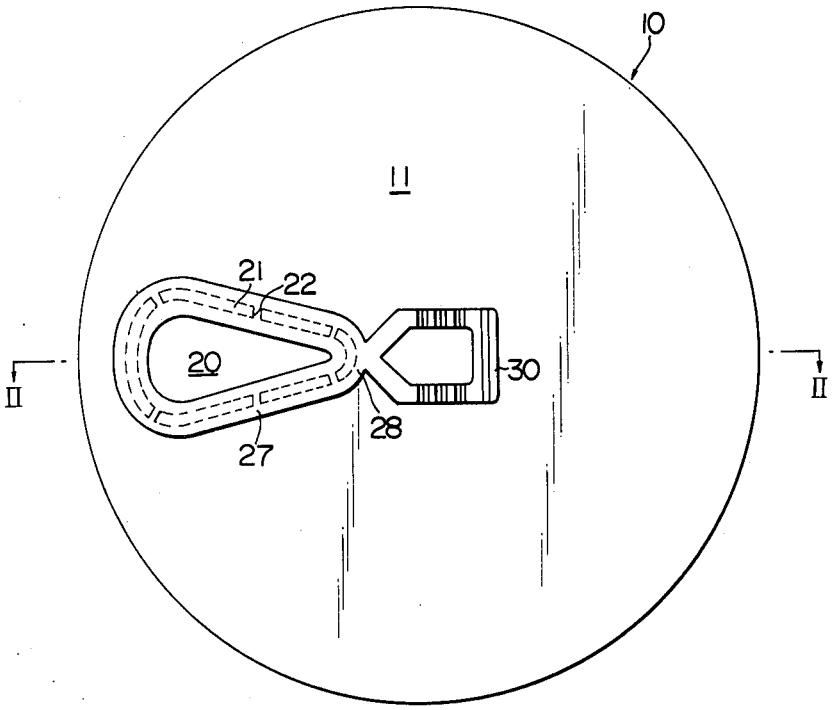
FIG. 1 is a plan view of one embodiment of the cover member having an openable portion defined by openable belt zones formed on the opposite surfaces of said cover sheet according to the present invention.
Figure 2:
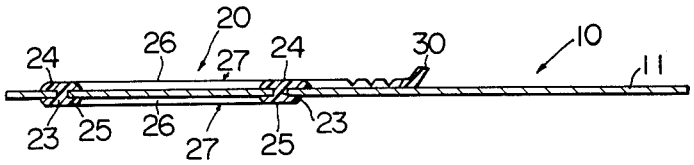
FIG. 2 is a cross-sectional view substantially taken along the line II—II of FIG. 1.

In the embodiment as shown in FIGS. 1 and 2, a cover member 10 comprising a circular cover sheet 11 which has an openable portion 20 defined by a series of slots 21 with discontinuous portions 22 is placed into a metal mould in an injection moulding machine and in the moulding operation, the slots 21 are filled with synthetic resin to form closure members 23 in the form of a double-ended rivet having the heads 24, 25 at the opposite ends which engage the opposite surfaces of the circular sheet to prevent the closure members from coming off the sheet and ensure a positive sealing by the synthetic resin filling up the slots 21. Since the opposite rivet heads 24, 25 of the closure members 23 also connect between the discontinuous portions 22 on the opposite surfaces of the circular sheet 11 to form resin continuous portions 26, the opposite rivet heads 24, 25 of the rivet-shaped closure members 23 and the resin continuous portions 26 cooperate with each other in forming ring-shaped continuous opening belt zones 27 along the periphery of the openable portion or opening portion 20 on the opposite surfaces of the circular cover sheet 11. Furthermore, one end of the openable continuous belt zone 27 on one or the outer surface (the upper surface as seen in FIG. 2) of the circular cover sheet 11 is integrally connected with a ring-shaped handle 30 at a portion 28.

After the cover member having the synthetic resin handle 30 as shown and described herein above has been placed onto a container filled by suitable conventional means, when it is desired to open the cover member, the handle 30 is first pulled upwardly whereupon the junction 28 between the handle 30 and openable continuous belt zone 27 is also raised because the handle is integral with the opening continuous zone. As the junction is raised, the openable continuous belt zone portions extending in the opposite directions from their junction with the handle are also raised. At this time, the discontinuous portions 22 of the slots 21 in the circular cover sheet 11 are sheared off by the closure member 23 having the rivet heads on the opposite surfaces of the circular sheet 11 and the opening continuous zones which connect the rivet heads at the opposite rivet heads of the closure members and as a result, the openable portion 20 can be easily removed from the rest of the cover member together with the openable continuous belt zone 27 to thereby open the container.

Figure 3:
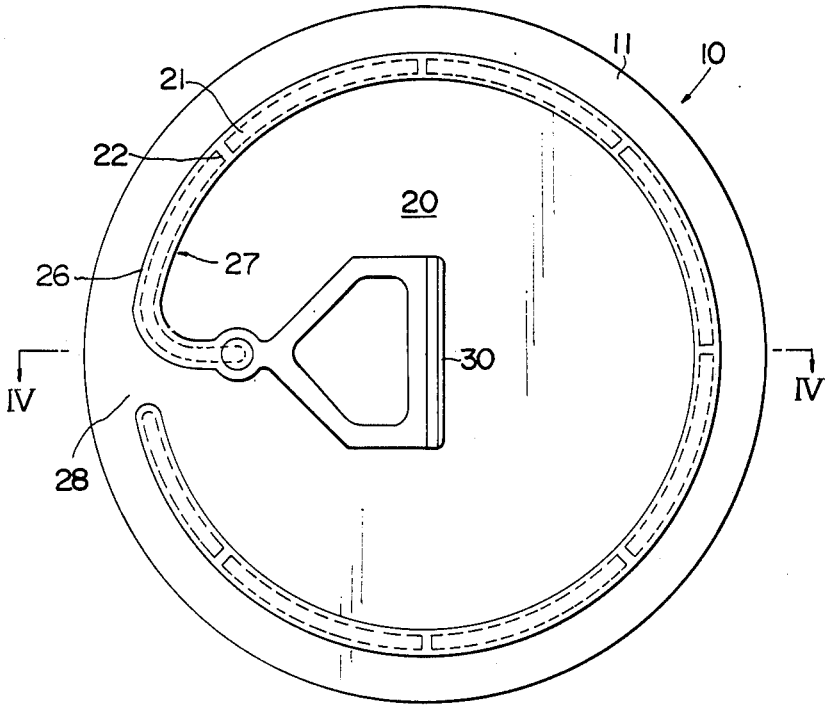
FIG. 3 is a plan view of another embodiment of the cover member having an opening portion defined by a series of slots substantially in one direction and occupies a substantial portion of the area of the cover sheet according to the present invention.
Figure 4:
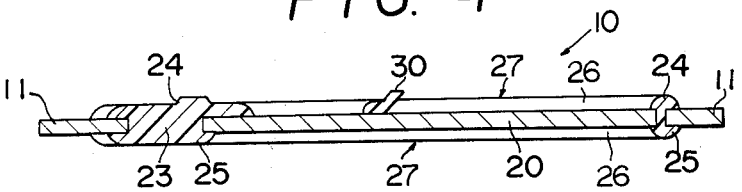
FIG. 4 is a cross-sectional view substantially taken along the line IV—IV of FIG. 3.

Another embodiment of No. 1 type cover member of the invention is shown in FIGS. 3 and 4. In this embodiment, the openable portion 20 occupies a substantial portion of the center area of the cover sheet 11 and the slots 21 having discontinuous portions 22 extent in one direction along a substantial portion of the periphery of the cover sheet 11 to define a substantial portion of the opening 20 and terminate at a discontinuous portion 28 without forming a complete annular configuration. The cover member blank preformed in this manner is placed into an injection moulding machine in which synthetic resin is injected into the slots 21 on the opposite surfaces of the cover sheet 11 to integrally form the closure members 23 each having rivet heads 24, 25 on the opposite surfaces of the cover sheet 11 and also form resin continuous member 26 which connect adjacent rivet heads 24, 25 together. The thus formed parts constitute an integral annular opening continuous belt zone 27 as a whole on each of the opposite surfaces of the cover sheet. The injection of resin also forms a handle 30 integral with the ring-shaped opening belt zone 27 on one of the opposite surfaces of the cover sheet 11 (the outer surface of the cover sheet).

In this embodiment, in use, when the handle 30 is pulled upwardly with respect to the rest of the cover member, the opening of the continuous belt zones 27 divides the cover sheet 11 into the inner or opening 20 a substantial portion of the periphery of which is separated from the cover sheet and the remaining discontinuous portion 28 which serves as the hinge about which the openable portion is opened or closed.

In this manner, the large opening through which a spoon or the like is inserted into the container can be not only easily opened but the opening is so arranged that the openable portion defining the opening is always thrown away together with the container.

Figure 5:
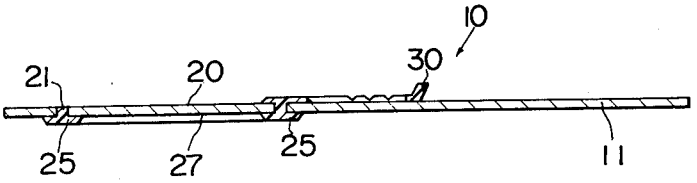
FIG. 5 is a cross-sectional view of another embodiment of the cover member which is similar to the cover member of FIG. 1, but has the openable belt zone defined on only the inner surface of the cover sheet.

Another embodiment of No. 1 type cover member is shown in FIG. 5 and in this embodiment, the cover member is formed of thermoplastic synthetic resin or paper. If good bonds are formed between thermoplastic synthetic resin filled in the slots and the opposite end faces of the cover sheet, when the slots 21 are filled with thermoplastic synthetic resin to form the closure member 23, only one end or the end of the closure member 23 which is positioned on the inner surface of the cover sheet may be provided with the rivet head 25.

Also in this embodiment, in use, when the opening belt zone 27 is pulled upwardly by means of the handle 30, the openable portion 20 is removed from the cover member to thereby open the container.

Figure 6:
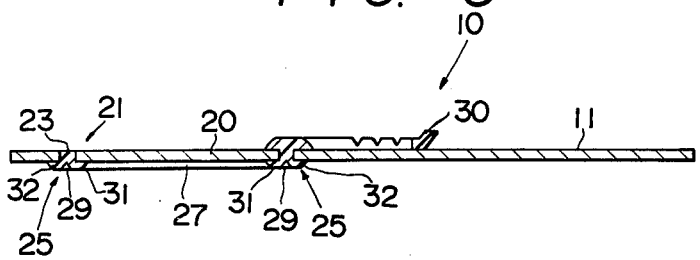
FIG. 6 is a cross-sectional view similar to the cover member of FIG. 5, but has a notch on a revet head.

FIG. 6 shows another embodiment of No. 1 type cover member and as shown in this Figure, a cut 29 is provided extending from a portion of the thickness of each closure member 23 through the thickness of the rivet head 25 associated with the closure member 23 in accordance with the contour of the weakened line of series of slots and when the handle 30 is pulled upwardly, the rivet head 25 is divided into inner and outer side portions 31, 32 and therefore, the closure members 23 and continuous belt zone 27 are also divided into inner and outer side portions. As a result, the inner portion 31 of the cut 29 is separated from the outer portion 32 which is so strongly sealed to the sheet 11 itself that when the cut 29 is cut said outer portion 32 is still retained to the original position, and displace upwardly without being obstructed by the cover sheet to thereby accelerate the opening of the openable portion 20.

Figure 7:
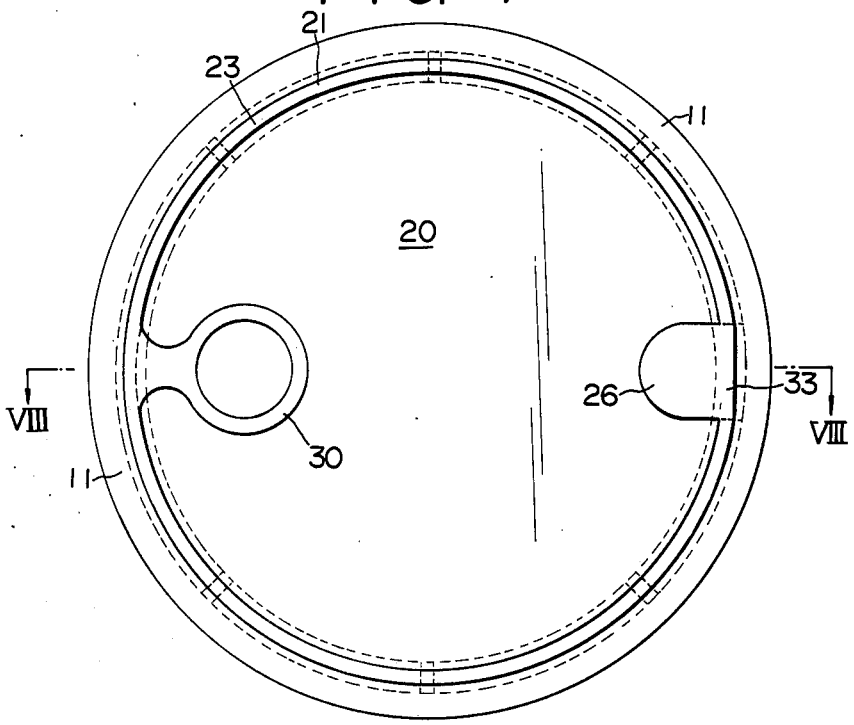
FIG. 7 is a plan view of another embodiment of the cover having the openable belt zone positively secured to the cover sheet in a portion between slots defining the openable portion according to the present invention.
Figure 8:
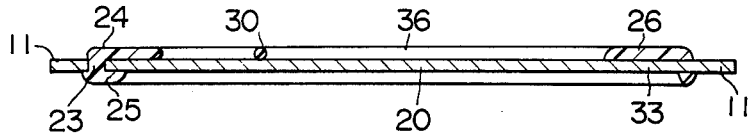
FIG. 8 is a cross-sectional view of said embodiment of FIG. 7.

Another embodiment of No. 1 type cover member is shown in FIGS. 7 and 8 and as shown in these Figures, the preformed cover member has the openabe portion 20 defined by the slots 21 in annular configuration, a portion of which is discontinuous as shown at 33 and the closure members 23 fill up the slots 21. At least one of the closure member rivet heads 24, 25 positioned on the outer and inner surfaces of the cover sheet 11 (the rivet head 24 in the illustrated embodiment) is contiguous to the resin continuous member 26 around the discontinuous area 33 to form a continuous structure. And before the closure member 23 and resin continuous member 26 are formed by injection, a specific adhesive is applied to the portion of the cover sheet 11 where the resin continuous member 26 is to be formed so that the injected resin continuous member will positively adhere to the cover sheet 11. Since the resin continuous member 26 is positively adhered to the cover sheet in this manner, even when the handle 30 is pulled upwardly to separate the resin closure member 26 from the cover sheet 11 to thereby open the openable portion 20 and since the resin continuous member 26 remains on the cover sheet 11 at the discontinuous area 33, the openable portion 20 is retained on the cover sheet 11 by means of the resin continuous member 26 and pivots about the resin continuous member 26 as the hinge to thereby accelerate the opening and closing of the openable portion 20.

Figure 9:
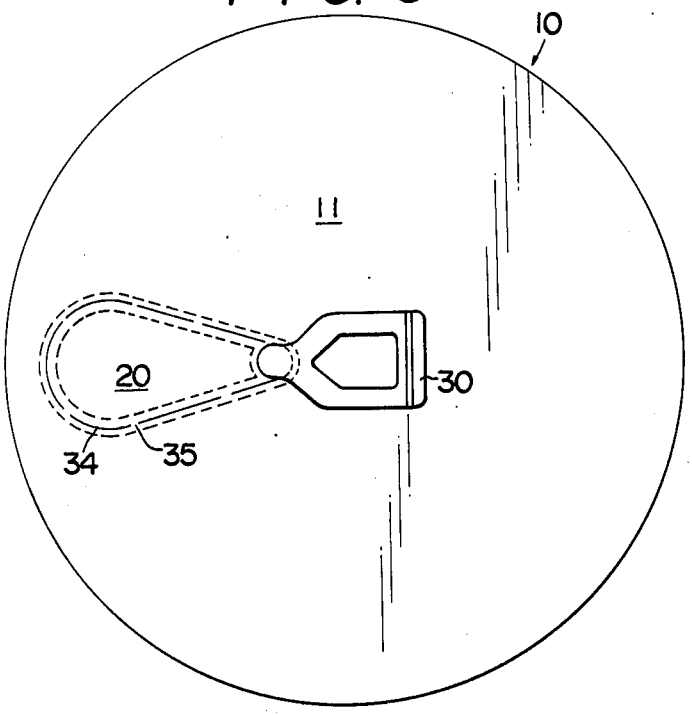
FIG. 9 is a plan view of another embodiment of the cover member having the openable portion defined by the slits, and the openable belt zone on the inner surface of the cover sheet along the slits according to the present invention.
Figure 10:
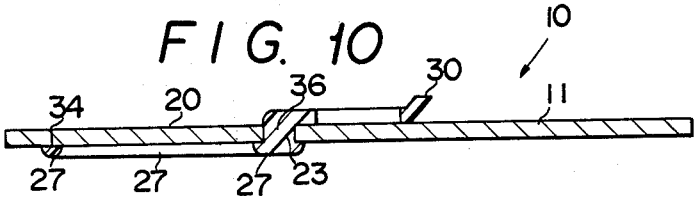
FIG. 10 is a cross-sectional view of the embodiment of FIG. 9.

Although the opening 20 is defined by the slots in the embodiments of No. 1 type cover member shown and described hereinabove, in the embodiments of No. 2 type cover member as shown in FIGS. 9 and 10, the cover member having the opening 20 defined by a circular line 34 of perforations or slits having the discontinuous portion 35 and a through hole 36 adjacent to and inwardly of the perforated line 34 is employed. The through hole 36 in the preformed cover member is filled with thermoplastic synthetic resin to form the closure member 23 having the handle 30 integrally formed therewith on the outer surface of the cover member and the openable belt zone 27 is adhered to the inner surface of the cover member and thus, the openable zone 27 is made integral with the closure member 23 on the said surface of the cover member.

Figure 11:
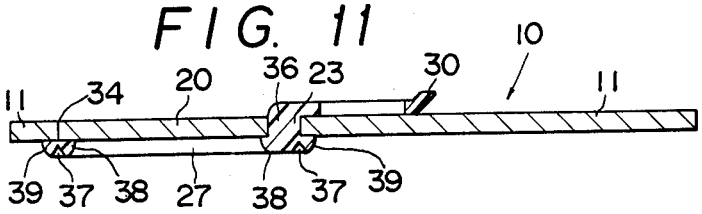
FIG. 11 is a cross-sectional view similar to FIG. 10, including a notch on a revet head along the slits.

With the above-mentioned construction of the embodiment of No. 2 type cover member of FIGS. 9 and 10, although the opening 20 is defined by the perforated line or slits 34, the opening is prevented from coming off the particular surface of the cover member by the continuous openable belt zone 27 and perforated line 34 and through hole 36 are effectively sealed by the continuous belt zone 27. In order to open the cover member, when the handle 30 is pulled upwardly, the closure member 23 and continuous openable belt zone 27 integral with the handle 30 are raised and the openable portion 20 can be easily removed from the cover member togehter with the continuous belt zone 27 by severing the discontinuous portion 35 of the perforated line 34. Another embodiment of No. 2 type cover member is shown in FIG. 11. As shown in this Figure, the annular continuous belt zone 27 having a suitable width is adhered to the inner surface of the cover sheet 11 along the perforated line 34 and provided on the inner surface thereof with cuts or notches 37 along the perforated line or slits 34. Thus, when the cover member is opened by pulling the handle 30 upwardly, the portions of continuous belt zone 27 positioned below the handle 30 are divided into inner and outer sides 38, 39 by notches 37 just below the perforated line 34. Thus, the inner sides 38 of the continuous zones can easily displace upwardly without being obstructed by the sheet 11. Therefore, by pulling the handle 30 upwardly, the continuous zones 27 are gradually divided into inner and outer sides 38, 39 whereby the openable portion 20 can be easily opened.

Figure 12:
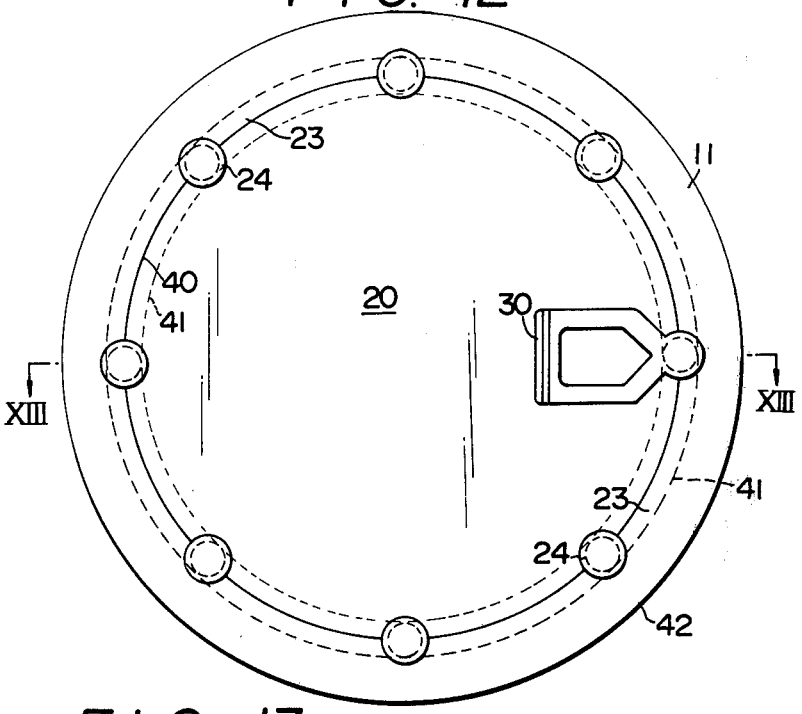
FIG. 12 is a plan view of another embodiment of the cover member having a an appropriate number of through holes along the periphery of the portion to be opened slits connecting the through holes on the outer surface of the cover sheet and opening the sheet on the inner surface of the cover sheet.
Figure 13:
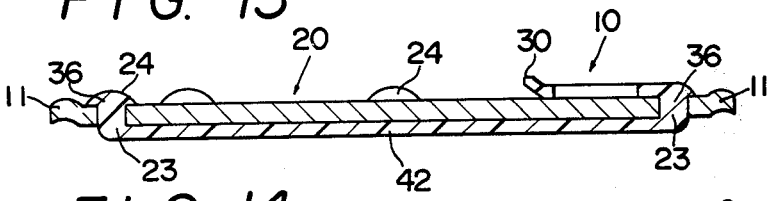
FIG. 13 is a cross-sectional view substantially taken along the line XIII—XIII of FIG. 12.
Figure 14:
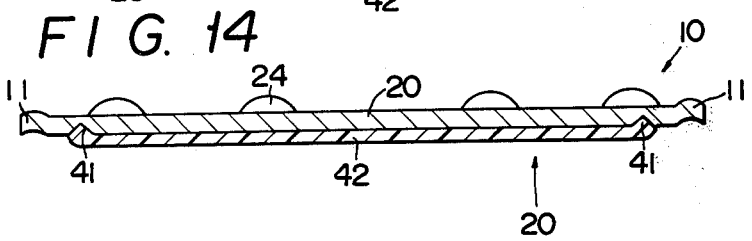
FIG. 14 is a cross-sectional view similar to FIG. 13, including a notch instead of the slit.

Embodiments of No. 3 type cover member are shown in FIGS. 12 through 16. In the embodiment of FIGS. 12, 13 and 14, the preformed cover member has a number of spaced through holes 36 provided along the periphery of the opening 20 and cut lines 40 (FIG. 12) or notch 41 (under side of the cover member 10 of FIG. 14) provided along the periphery of the opening portion 20 for connecting the through holes 36 together. By injection moulding of thermal setting synthetic resin closure members 23 are formed in the through holes 36 and rivet heads 24 are formed on the upper ends of the closure members 23 respectively. By the injection moulding, the closure members and rivet heads 23 and 24 are integrally formed, at least the opening sheet 42 extending along the whole inner surface of the openable portion 20 and the closure members 23 are integrally formed and one of the closure members 23 and the handle 30 on the surface thereof are integrally formed.

Figure 15:
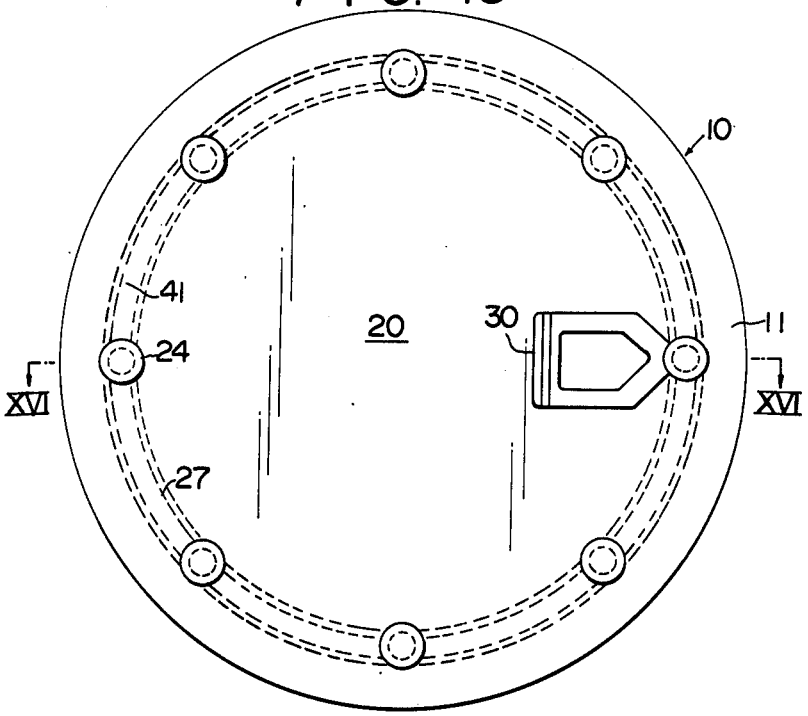
FIG. 15 is a plan view of another embodiment of the cover member similar to the cover member of FIG. 13, but has the openable belt zone adhered to the inner surface of the cover sheet in place of the opening sheet of FIG. 13.
Figure 16:
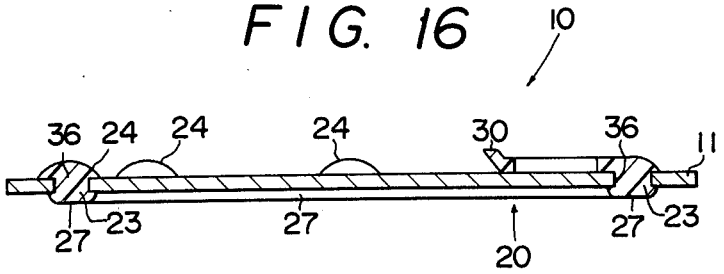
FIG. 16 is a cross-sectional view of said embodiment of FIG. 15.

With the construction of the cover member 10 as described, when the handle 30 is pulled upwardly, the pulling action is applied to the opening sheet 42 on the inner surface of the cover sheet the movement of which opening sheet 42 is controlled by the rivet heads 24 and the cover sheet 11 is sheared upwardly along the cut line 40 or notch 41 adjacent to the periphery of the opening sheet 42 to thereby easily open the openable portion 20. Another embodiment of No. 3 type cover member is shown in FIGS. 15 and 16 and the embodiment of these Figures has continuous openable belt bands 27 integrally formed with the closure members 23 filling the through holes 36 along the cut lines or perforated lines 43 on the inner surface of the cover sheet 11 instead of the opening sheet 42 extending along the inner surface of the cover sheet of FIGS. 12 and 13. Thus, the continuous openable belt band 27 is held in position by the rivet heads 24 against lateral displacement. In this embodiment, when the handle 30 is pulled upwardly, the continuous belt zone 27 is positively and gradually pulled upwardly without lateral displacement to thereby sever the cover sheet along the perforated line 43 whereby the openable portion 20 is raised and easily opened.

Figure 17:
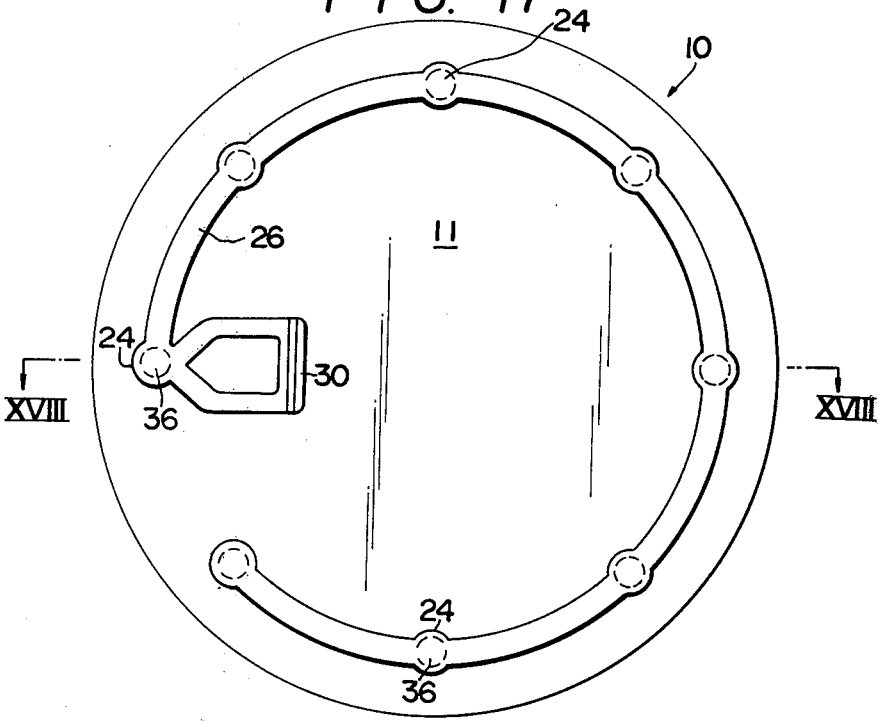
FIG. 17 is a plan view of another embodiment of the cover member in which all the closure member filling up a plurality of small through holes in the cover sheet are integrally formed with the openable belt zone on only the outer surface of the cover sheet whereby as the part that makes up the openable belt zone is pulled upwardly, the closure members are in succession pulled out of the small through holes.
Figure 18:
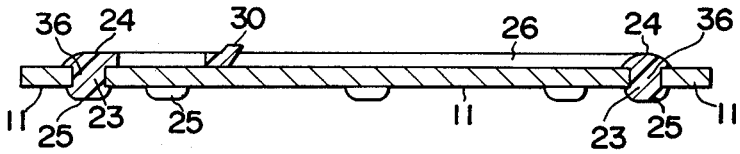
FIG. 18 is a cross-sectional view taken substantially along the line XVIII—XVIII of FIG. 17.

Another embodiment of No. 4 type cover member of the present invention is shown in FIGS. 17 and 18. As shown in these Figures, a number of small through holes 36 are provided in peripherally spaced relationship in the cover sheet 11, the closure members 23 fill the through holes 36 and the rivet heads 24, 25 are formed at the opposite ends thereof to engage the cover sheet 11 to thereby prevent the closure members 23 from coming off the cover sheet and provide sealing for the through holes and accordingly, the opening portion. The rivet heads 24 are connected together by the continuous resin member 26 and the handle 30 is formed at one end of the continuous resin member 26. The lower rivet heads 25 are preferably small, just large enough to prevent the closure members 23 from coming off the cover sheet 11. In the cover member formed by injecting thermoplastic synthetic resin into the through holes as described hereinabove, when the handle 30 is pulled upwardly, an upward action is applied to the closure members 23 and the lower rivet heads 24 which are small just large enough to hold the closure members against falling and to provide necessary sealing deformation whereby the closure members 23 can be pulled upwardly because the lower rivet heads 25 deform or reduce their size as the closures 23 are pulled upwardly. Thus, in this embodiment, all the closure members fill the plural through holes which are provided in the cover sheet can be automatically and easily pulled out of the through holes in succession by pulling the handle upwardly. Thus, the embodiment of the cover member can be conveniently employed as an inner cap for a shaking-type container filled with particular powdery product.

While several embodiments of the invention have been shown and described in detail, it will be understood that the same are for illustration purpose only and not to be taken as a definition of the invention, reference being had for this purpose to the appended claims.

What is claimed is:

1. A container cover member with openable or removable portion comprising a cover sheet preformed by blanking a sheet material formed of paper or thermoplastic synthetic resin to a desired shape and having weakened portion defining the openable or removable portion in appropriate place of said cover sheet; and closure members one of which has a handle formed by filling and sealing up said weakened portion with thermoplastic synthetic resin different from said thermoplastic synthetic resin forming said cover sheet whereby when said handle is pulled upwardly, an opening is easily made in said cover.

2. The container cover as set forth in claim 1, in which said weakened portion is formed by series of slots.

3. The openable container cover as set forth in claim 2, in which said closure members are formed by filling up the series of slots the opening in said cover sheet and having discontinuous portions with resin so as to integrally form rivet heads at the opposite ends of the closure members on the outer and inner surfaces of the cover sheet, resin continuous openable belt zone is formed so as to connect said rivet heads even in said discontinuous portions and handle for opening is integrally formed with one of said closure heads.

4. The openable container cover as set forth in claim 1, in which one through hole in said cover sheet is is filled up with one of said closure members having the base of said handle connected to the one closure member and said one closure member adhered to the inner surface of said cover sheet and said openable belt zone are integrally formed along the weakened portion defining an opening in said cover sheet.

5. The openable container cover as set forth in claim 1, in which a desired number of through holes are provided along the peripheral line of the opening, series of slits are provided on the inner surface of said cover sheet for connecting the through holes together and said closure members filled in said through holes are integrally formed with the opening belt zone adhered to the inner surface of said cover sheet along said series of slits.

6. The openable container cover as set forth in claim 1, in which a plurality of through holes are provided in said cover sheet and said closure members filling said through holes are connected together at only the upper ends thereof on the outer surface of said cover sheet.

7. A method for manufacturing the openable container cover as set forth in claim 1, comprising the steps of blanking a cover sheet having a desired shape out of a sheet of paper or thermoplastic synthetic resin, said blanking step simultaneously forming a weakened portion in said cover sheet or being followed by said through cut portion formation; and filling said weakened portion with thermoplastic synthetic resin to form a sealing member having a handle integrally formed therewith.

8. The method for manufacturing the openable container cover having a sealing member of material different from the material forming said cover sheet as set forth in claim 7, in which after said cover sheet having a through cut portion of a desired shape is preformed, an adhesive layer is applied to a specific area of the end face facing said through cut portion and then said through cut portion is filled with thermoplastic synthetic resin different from the material forming said cover blank so as to form a sealing member.

* * * * *